United States Patent [19]

Tsuchiya et al.

[11] 4,298,318

[45] Nov. 3, 1981

[54] ROTARY VALVE FOR FLUID MOTOR OR PUMP

[75] Inventors: Shunji Tsuchiya, Fujisawa; Takashi Takamatsu, Kamakura, both of Japan

[73] Assignee: Tokyo Keiki Company Limited, Tokyo, Japan

[21] Appl. No.: 97,938

[22] Filed: Nov. 27, 1979

Related U.S. Application Data

[63] Continuation of Ser. No. 915,211, Jun. 13, 1978, abandoned.

[30] Foreign Application Priority Data

Mar. 29, 1978 [JP] Japan ..... 53-40551

[51] Int. Cl.[3] ..... F01C 21/12

[52] U.S. Cl. ..... 418/61 B; 137/625.21; 418/144

[58] Field of Search ..... 418/61 B, 144, 104; 137/625.21

[56] References Cited

U.S. PATENT DOCUMENTS 3,316,814 5/1967 Charlson ..... 418/61 B
3,452,680 7/1969 White, Jr. ..... 418/61 B
3,513,879 5/1970 Adams ..... 137/625.21
3,976,407 8/1976 Gerlach ..... 418/144 X

*Primary Examiner*—Leonard E. Smith
*Attorney, Agent, or Firm*—Haseltine & Lake

[57] ABSTRACT

A rotary valve for changing the connections of the fluid inlet passages and the fluid outlet passages of a Gerotor type fluid rotary machine in which the fluid is contracted and expanded by a plurality of cavities defined by the teeth formed on a stator and a rotor in response to the orbital rotation of the rotor formed with one less external tooth than the number of the internal teeth on the stator. The rotary valve selectively connects the fluid passages with the Gerotor cavities by means of its rotary commutator which orbits with a phase difference of 90° with respect to the Gerotor rotor, and the commutator is rotatably accommodated in a spacer disposed between an end cover and a port member having a plurality of fluid passages. The clearance at each side of the commutator is permanently determined by the width of the spacer. A seal is disposed between the opposed sides of the commutator and the port member and that of the commutator and the end cover so as to prevent reduction in the Volumetric efficiency due to leakage of the fluid flowing through the clearances caused at both sides of the commutator.

7 Claims, 12 Drawing Figures

ROTARY VALVE FOR FLUID MOTOR OR PUMP

This is a continuation of application Ser. No. 915,211 filed June 13, 1978, now abandoned.

BACKGROUND OF THE INVENTION

The present invention relates to valves designed for use with Gerotor rotary machines which are used as fluid pumps or motors in which the fluid introduced is contracted and expanded by a meshing gear system generally known as a Gerotor, and more particularly the invention relates to a rotary valve including sealing means designed to prevent leakage of fluid caused between the high pressure side and the low pressure side of the commutator.

With a fluid motor or pump of the Gerotor type in which a rotor formed with one less external tooth than the number of internal teeth of a stator, is rotated in eccentric mesh with the stator and a pluralty of expanding and contracting cavities are defined by the teeth of the stator and the rotor in response to the eccentric rotation of the rotor, it has been the practice to use a rotary valve to selectively connect the fluid passages with the Gerotor cavities so that a hydraulic oil is supplied to impart a turning force to the rotor in the case of a fluid motor, while a hydraulic oil is discharged from the contracting Gerotor cavities in the case of a fluid pump.

With a known rotary valve of this type, due to the fact that the commutator is rotated within the valve chamber, a clearance which is as small as to not impede the rotation of the commutator is provided at each side of the commutator, and consequently there is a disadvantage that the oil tends to leak from the high pressure side to the low pressure side within the valve chamber, thus diminishing the volumetric efficiency of a motor or pump. As a result, the width of the clearance on each side of the commutator has been made very small so far as the rotation of the commutator is not impeded, thus requiring a high degree of machining accuracy for the component parts of the rotary valve. However, there is a disadvantage that even if the component parts with a high degree of accuracy are used, the clamping force of bolts or the like used in assembling the valve tends to distort the component parts of the valve chamber and moreover the existence of the high oil pressure portion and the low oil pressure portion within the valve chamber tends to similarly distort the component parts of the valve chamber by the pressure difference between the two portions, thus increasing the width of the clearance at each side of the commutator. In view of these circumstances, rotary valves of a construction in which the clearance at each side of a commutator is adjusted in response to the pressure difference in the valve and rotary valves of the construction which reduces distortion of the component parts have been proposed by the inventors, YOKOYAMA and TAKAMATSU, of the present invention as disclosed in Japanese Patent Application No. 67863/77 and No. 109940/77.

SUMMARY OF THE INVENTION

With a view to overcoming the foregoing problems of distortion and leakage in the prior art rotary valves, the present invention has been made to provide improvements in the inventions of the previously mentioned patent applications.

It is therefore an object of the present invention to provide a rotary valve in which sealing means is disposed in the clearance at least on one side of a commutator, thus preventing leakage of fluid between the high and low pressure sides within a valve chamber and thereby improving greatly the efficiency of a fluid motor or pump of the Gerotor type.

It is another object of the invention to provide a rotary valve in which sealing means is provided in each of a plurality of location on the sides of a commutator, whereby leakage of the fluid within the valve chamber is positively prevented and the fluid pressures applied to the commutator are balanced to minimize distortion of the commutator as far as possible.

It is still another object of the invention to provide a rotary valve in which the location of sealing means disposed on each side of a commutator is adjusted to as to prevent leakage of the fluid and application of the unbalanced pressures to the commutator.

It is still another object of the invention to provide a rotary valve in which sealing means comprises a cap seal of a wear resisting material which is disposed in contact with a commutator and an O-ring disposed inside the cap seal.

These and other objects, advantages and uses will become more apparent upon a reading of the following detailed description and drawings.

DESCRIPTION OF THE PREFERRED EMBODIMENTS

A rotary valve provided in accordance with this invention is designed for use with fluid rotary machines of the Gerotor type. Irrespective of whether the rotary machine is used as a fluid motor or pump. The Gerotor unit of identical construction is used in either case and the machine is usable either as a motor or pump. In the embodiments described hereunder, the rotary valve of this invention is used with a fluid motor of the Gerotor type.

Figure 1:
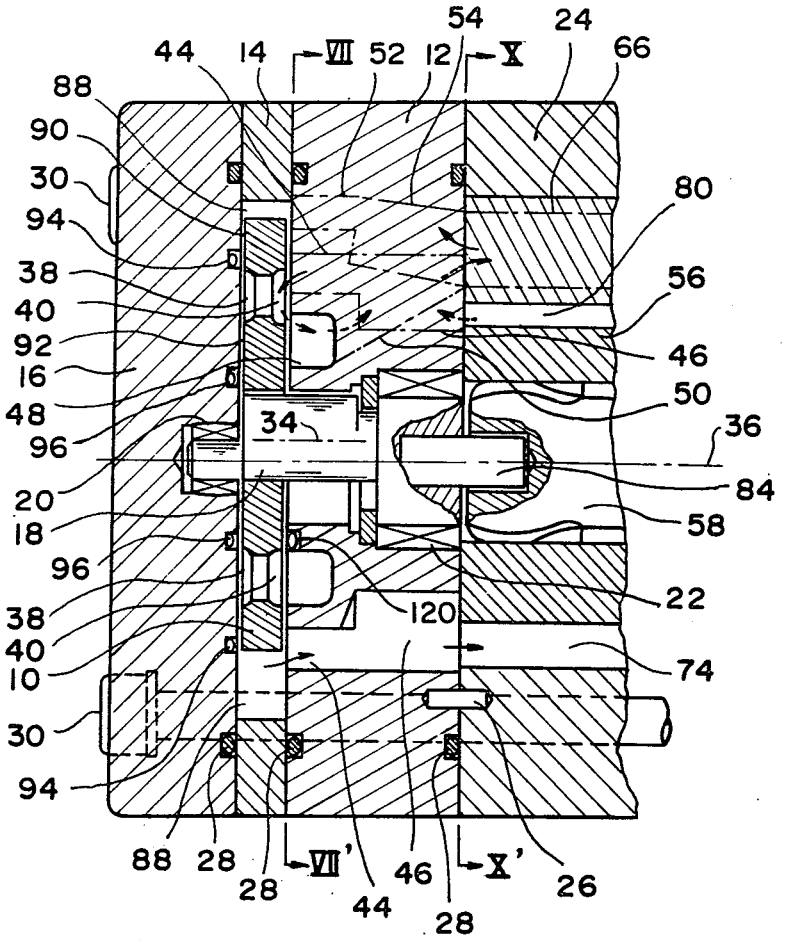
FIG. 1 is a longitudinal sectional view showing the construction of a rotary valve according to the invention, which includes sealing means for use with a fluid motor of the Gerotor type by way of example.

Referring now to FIG. 1, therein is illustrated a longitudinal sectional view of a rotary valve according to the invention and a partial sectional view of a Gerotor unit arranged adjacent the rotary valve. As shown in the Figure, the rotary valve comprises a commutator 10, a port member 12, a spacer 14, an end cover 16 and an eccentric circular cam 18, the eccentric circular cam 18 being rotatably supported in roller bearings 20 and 22 which are assembled in the end cover 16 and the port member 12, respectively. The end cover 16 and the port member 12 are assembled to interpose the spacer 14 thus defining a valve chamber, and these component parts and a Gerotor stator 24 are accurately positioned by locating pins 26 and firmly fastened together with bolts 30 with seals 28 interposed therebetween. The commutator 10 is rotatably mounted on the eccentric circular cam 18 within the valve chamber.

Figure 2:
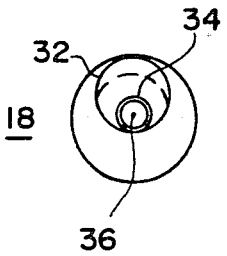
FIG. 2 is a left end view of the eccentric circular cam used in the rotary valve shown in FIG. 1.
Figure 3:
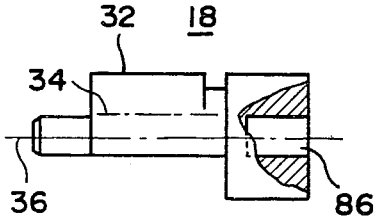
FIG. 3 is a side view showing, partly in section, the eccentric circular cam.
Figure 4:
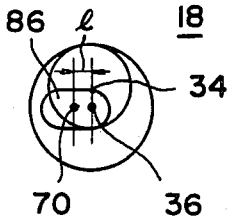
FIG. 4 is a right end view of the eccentric circular cam.

As will be seen from FIGS. 2, 3 and 4, a cam portion 32 of the eccentric circular cam 18 has its center 34 offset from an axis of rotation 36 of the eccentric circular cam 18, and the commutator 10 is fitted on the cam portion 32 in FIG. 1. As a result, when the cam 18 is rotated, the commutator 10 is rotated within the valve chamber eccentrically with respect to the axis 36 of the cam 18. In the condition shown in FIG. 1, the commutator 10 is in the upwardly eccentric position.

Figure 5:
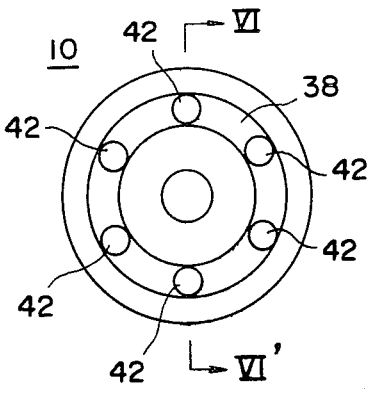
FIG. 5 is a front view of the commutator used in the rotary valve shown in FIG. 1.
Figure 6:
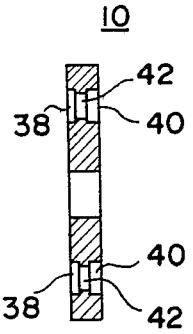
FIG. 6 is a sectional view taken along line VI—VI' in FIG. 5.

Referring now to FIGS. 5 and 6, the commutator 10 is provided with annular grooves 38 and 40 which are formed in its sides, and these annular grooves 38 and 40 are connected to with each other through a suitable number of holes 42.

Figure 7:
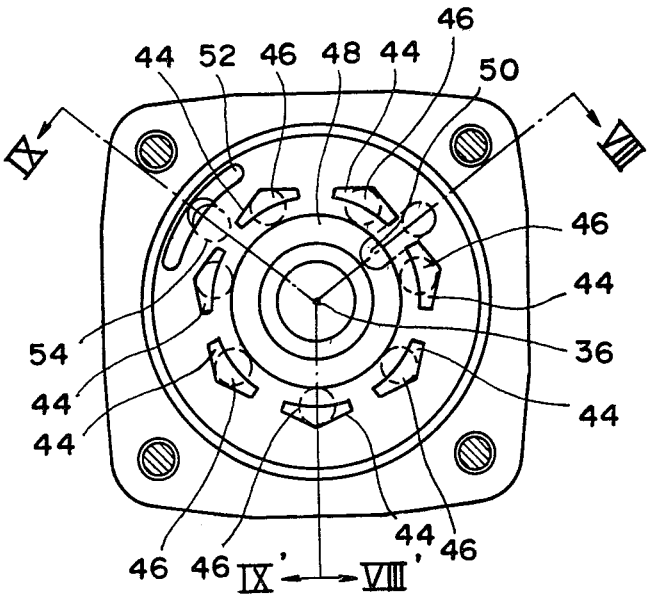
FIG. 7 is a front view of the port member looked in the direction of line VII—VII' in FIG. 1.
Figure 8:
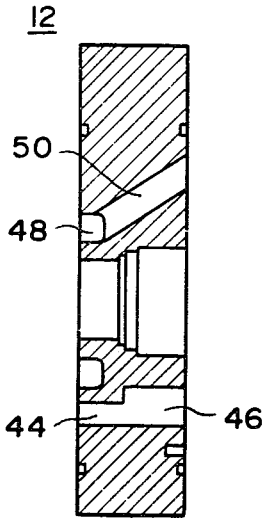
FIG. 8 is a sectional view taken along line VIII—VIII' in FIG. 7.
Figure 9:
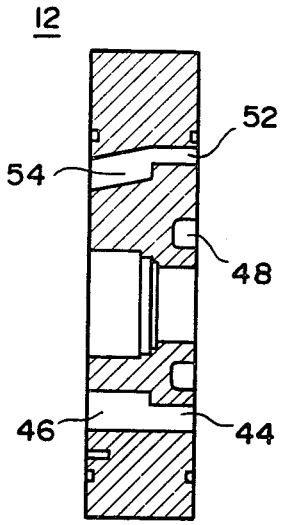
FIG. 9 is a sectional view taken along line IX—IX' in FIG. 7.

Next, referring to FIG. 7 as seen in the direction of the lines VII—VII' in FIG. 1 and FIGS. 8 and 9 showing sectional views taken along lines VIII—VIII' and IX—IX' of FIG. 7, the side of the port member 12 which is opposite the commutator 10, is formed with seven diamond-shaped grooves 44 which are arranged at equal spacing along the same circumference around the axis 36 of the eccentric circular cam 18, and these diamond-shaped grooves 44 are connected to the other side of the port member 12 through holes 46. An annular groove 48 is similarly formed concentrically with the shaft center 36 on the inner side of the grooves 44, and the groove 48 is connected to the other side of the port member 12 through a hole 50 which is provided at the section VIII—VIII'. An elongated elliptical groove 52 which is circumferentially curved about the shaft center 36 is formed at the section IX—IX' or the outer side of the diamond-shaped grooves 44, and the groove 52 is connected to the other side of the port member 12 through a hole 54.

Figure 10:
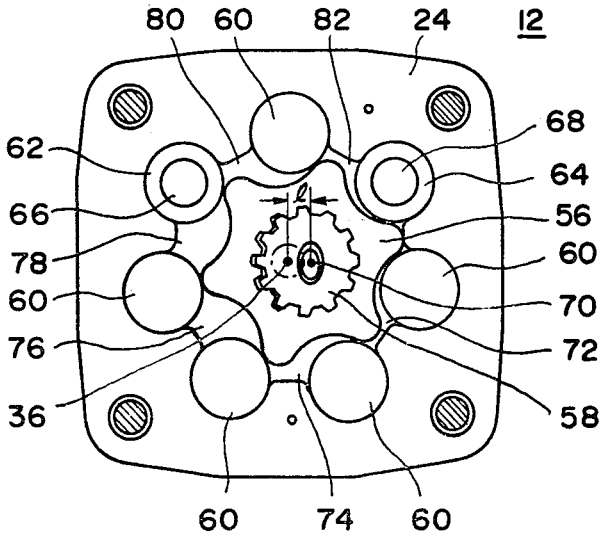
FIG. 10 is a front view of the Gerotor unit looked in the direction of line X—X' in FIG. 1.

Next, referring to FIG. 10 as seen in the direction of line X—X' in FIG. 1 and FIG. 1, the Gerotor unit comprises the stator 24, a rotor 56 and a drive shaft 58, and five round bars 60 and hollow bushings 62 and 64 are fitted in the stator 24 thus forming seven internal teeth thereon. Holes 66 and 68 in the hollow bushings 62 and 64 constitute oil inlet and outlet passages and their positions respectively coincide with the directions 36-IX and 36-VIII in the port member shown in FIG. 7, that is, the hole 66 of the stator 24 communicates with the hole 54 of the port member 12 and the hole 68 of the stator 24 communicates with the hole 50 of the port member 12. The rotor 56 formed with one less tooth than the number of teeth of the stator 24, internally contacts the internal teeth of the stator 24, and the rotor 56 which is in mesh with the internal teeth of the stator 24 rotates about the shaft center 36 of the stator 24 while rotating on its axis. The orbiting of a shaft center 70 of the rotor 56 follows a path as shown by the chain dotted circle in the FIG. 10. The shaft center 36 of the stator 24 coincides with the axis of rotation 36 of the eccentric circular cam 18 shown in FIGS. 3 and 4 as well as in FIG. 7. A drive shaft 58 is coupled by spline grooves to the central portion of the rotor 56, and the rotation of the rotor 56 on its axis is transmitted to the drive shaft 58. In this case, the shaft center 70 of the rotor 56 makes one rotation about the shaft center 36 of the stator 24 or one orbital rotation for every 1/6 rotation of the rotor 56 on its axis, for example. As shown in FIG. 10, seven cavities or chambers which are separated from one another are defined between the stator 24 and the rotor 56, and each of the cavities is varied in volume as the rotor 56 is rotated. In the condition shown in FIG. 10, when the rotor 56 is rotated clockwise, the cavities 72, 74 and 76 are increased in volume and the other cavities 78, 80 and 82 are decreased in volume. As a result, if hydraulic oil is introduced into the cavities 72, 74 and 76 and the oil in the other cavities is discharged to the outlet, the rotor 56 is rotated clockwise and the rotation on its axis is transmitted to the drive shaft 58, thus causing the Gerotor to operate as a motor. In this case, since there is the previously mentioned relation between the orbiting and the rotation on its axis for making one rotation of the drive shaft 58, the hydraulic oil for seven cavities $\times$ 6 (rotations) = 42 cavities is introduced. Thus, the hydraulic motor of the Gerotor type is capable of providing 1/6 speed reduction with an output torque which is six times that of the prior art hydraulic motors. The previously mentioned rotary valve is designed so that hydraulic oil is alternately supplied to and discharged from the Gerotor cavities so as to continuously rotate the Gerotor rotor 56 smoothly. For this purpose, as shown in FIG. 1, the rotation of the drive shaft 58 is transmitted to the eccentric circular cam 18 by way of a pin 84 and the commutator 10 is rotated to change the connections of the oil passages. On the drive shaft 58 side the pin 84 is fitted in the central portion of the drive shaft 58, and on the cam 18 side the pin 84 is fitted in an elliptical hole 86 in the cam 18 shown in FIG. 4. As shown in FIG. 10, the shaft center 70 of the drive shaft 58 moves to describe a circular path in response to the rotation of the rotor 56, and thus the pin 84 is fitted in the hole 86 at a position so that the shaft center 70 of the pin 84 is offset from the center of axis 36 of the cam 18 by an amount corresponding to the radius l of the circular path as shown in FIG. 4, thus transmitting the orbital rotation of the rotor 56 to the eccentric cam 18.

Next, the flow of the oil to the Gerotor motor will be described. The description will be made assuming that the drive shaft 58 is rotated in a clockwise direction as seen from the rotary valve side and that the commutator 10 is in the position of FIG. 1 and the rotor 56 is in the position of FIG. 10. In this case, the hole 66 of the stator 24 shown in FIG. 10 constitutes an oil inlet passage and the hole 68 constitutes an oil outlet passage. Since the hole 66 is in communication with the hole 54 of the port member 12 shown in FIG. 7, the hydraulic oil supplied to the hole 66 flows through the hole 54 and the elongated elliptical groove 52 into a cavity 88 on the outer periphery of the commutator 10 in the valve chamber shown in FIG. 1. To facilitate the understanding of this oil flow path, the positions of the hole 54 and the elongated elliptical groove 52 of the port member 12 are moved and shown by the chain-dotted lines on the section in FIG. 1. Since in the condition shown in FIG. 1 the commutator 10 is in the upper position and the outer peripheral cavity 88 of the commutator 10 is in comunication with the lower diamond-shaped groove 44 and the hole 46 of the port member 12, the hydraulic oil supplied to the cavity 88 flows through this passage and enters into the cavity 74 between the stator 24 and the rotor 56. In other words, in FIG. 10, the hydraulic oil is supplied to the cavity 74 with the result that the volume of the cavity 74 is increased and the rotor 56 is rotated clockwise. In this case, the cavities 72 and 76 are also in communication with the outer peripheral cavity 88 of the commutator 10 and consequently the hydraulic oil is simultaneously introduced into these cavities and these forces are added to rotate the rotor 56. On the other hand, when the rotor 56 is rotated clockwise in FIG. 10, the cavity 80 is decreased in volume and this cavity 80 connects another upper hole 46 and diamond-shaped groove 44 of the port member 12. The latter groove 44 is also in communication with the annular groove 38 of the commutator 10 through the annular groove 40 of the commutator 10 and with the outlet passage 68 of the stator 24 through the hole 50 of the port member 12. As a result, the oil in the cavity 80 which is decreased in volume between the stator 24 and the rotor 56, is discharged through this path thus rotating the rotor 56 smoothly. In this case, the cavities 78 and 82 are simultaneously decreased in volume and the oil in these cavities is also discharged through similar paths. To facilitate the understanding of the paths of the discharge oil passages, the holes 46, the upper diamond-shaped groove 44 and the hole 54 of the port member 12 of FIG. 7 are moved and shown by the chain-dotted lines on the section in FIG. 1. While the operation of the valve has been described under the condition in which the commutator 10 is in the position shown in FIG. 1, when the Gerotor rotor 56 is rotated in this manner, the commutator 10 is simultaneously rotated so that the cavities defined by the stator 24 and the rotor 56 are varied in volume and consequently the commutator 10 automatically changes the hydraulic oil inlet and outlet passages in the port member 12, thus continuously rotating the rotor 56.

While the construction and operation of the Gerotor type motor with the rotary valve have been described briefly, such Gerotor type motor or pump is disadvantageous in that the oil leaks from the high pressure portion to the low pressure portion in the rotary valve thus diminishing the efficiency of the machine. Considering the case of the Gerotor type motor shown in FIG. 1, the cavity 88 in the valve chamber is on the inlet side of hydraulic oil with a higher pressure and the annular grooves 38 and 40 of the commutator 10 and the annular groove 48 of the port member 12 are on the outlet side of hydraulic oil with a lower pressure. As a result, the oil leaks from the inlet side to the outlet side through a gap 90 between the commutator 10 and the end cover 16, and the oil also leaks from the low pressure side to a drain circuit through a gap 92, the clearance around the eccentric circular cam 18 and around the peripheral portions of the roller bearing 22 and the drive shaft 58, thus correspondingly diminishing the volumetric efficiency of the Gerotor type motor. While this represents the case when the Gerotor motor is rotated clockwise as seen from the side of the cam 18, the same applies to the case where the motor is rotated in a counterclockwise direction, since the high pressure portion and the low pressure portion are reversed thus causing the leakage of the oil between the same portions. The same applies to the case where the Gerotor motor is used as a pump. Thus, in the past it has been customary to use a method of improving the machining accuracy of the spacer 14, the commutator 10 and the end cover 16 so as to make the clearance on each side of the commutator 10 as small as possible and thereby to minimize the oil leakage. However, even if such a method is used, there still exists the possibility of increasing the width of the clearances with resulting increase in the oil leakage due to possible distortion of the component parts under the effect of the clamping pressure of the clamping bolts used in assembling the rotary valve and the pressure difference between the high pressure portion and the low pressure portion within the valve chamber.

Figure 11:
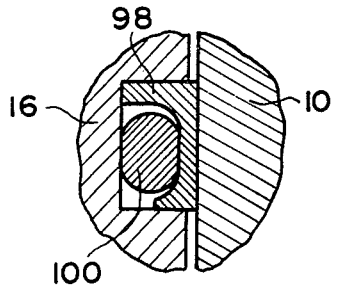
FIG. 11 is an enlarged partial sectional view showing an exemplary construction of the sealing structure used in the rotary valve of this invention.

As shown in FIG. 1, the rotary valve of this invention includes annular seals 94 and 96 inserted in the portions of the end cover 16 which face the gaps 90 and 92 to prevent the leakage of oil in these portions. While, in the embodiment shown in FIG. 1, two annular seals are arranged on the end cover side, it is possible to obtain a certain degree of leakage preventing effect with only one such annular seal or alternatively as shown in FIG. 1 two additional it is possible to arrange seals in 120 the gaps on the side of the commutator 10 which is opposite the port member 12, thus using a total of four seals and thereby providing a complete sealing structure. The annular seal used with the sealing structure of this invention may suitably be comprised of a so-called gap seal shown by the sectional view of FIG. 11. The illustrated cap seal includes a portion 98 made from Teflon and a portion 100 consisting of a rubber O-ring, and the cap seal may be effectively used in rotating portions with a reduced wear and improved sealing effect. The Teflon used for the portion 98 should preferably be bronze-loaded Teflon 1xx6 manufactured by Du Pont or its equivalent.

As regards the positions of the sealing means 94 and 96 on the end cover 16 shown in FIG. 1, their positions must be adjusted in such a manner that the forces applied in the axial direction of the commutator side by the hydraulic oil entering the areas of the commutator 10, that is, the area of the commutator outside the sealing means 94, the area of the commutator side located between the sealing means 94 and 96 and the area of the commutator side located inside the sealing means 96, are balanced with respect to the eccentric axis 34 of the cam 18.

On the other hand, where the drive shaft 58 is rotated counterclockwise so that the cavity 88 of the commutator 10 has a lower pressure and the annular grooves 38 and 40 of the commutator 10 have a higher pressure, the sealing means 94 and 96 similarly prevent the leakage of the oil through the gaps between the commutator 10 and the end cover 16 and/or the port member 12, and the forces applied to the side of the commutator 10 are also balanced with respect to the axis 34 of the eccentric circular cam 18.

The sealing structure used with the rotary valve of this invention is not limited to applications such as the Gerotor type motors and pumps, and it may be incorporated in any other machine having a similar rotary valve to produce the similar effect. While, in the above-described embodiment, the commutator is of the type which is rotated eccentrically within the valve chamber, the sealing structure of this invention can be used effectively in the similar manner with a commutator of the type which is rotated concentrically about the center of an valve chamber by means of the ordinary shaft instead of a cam shaft.

Figure 12:
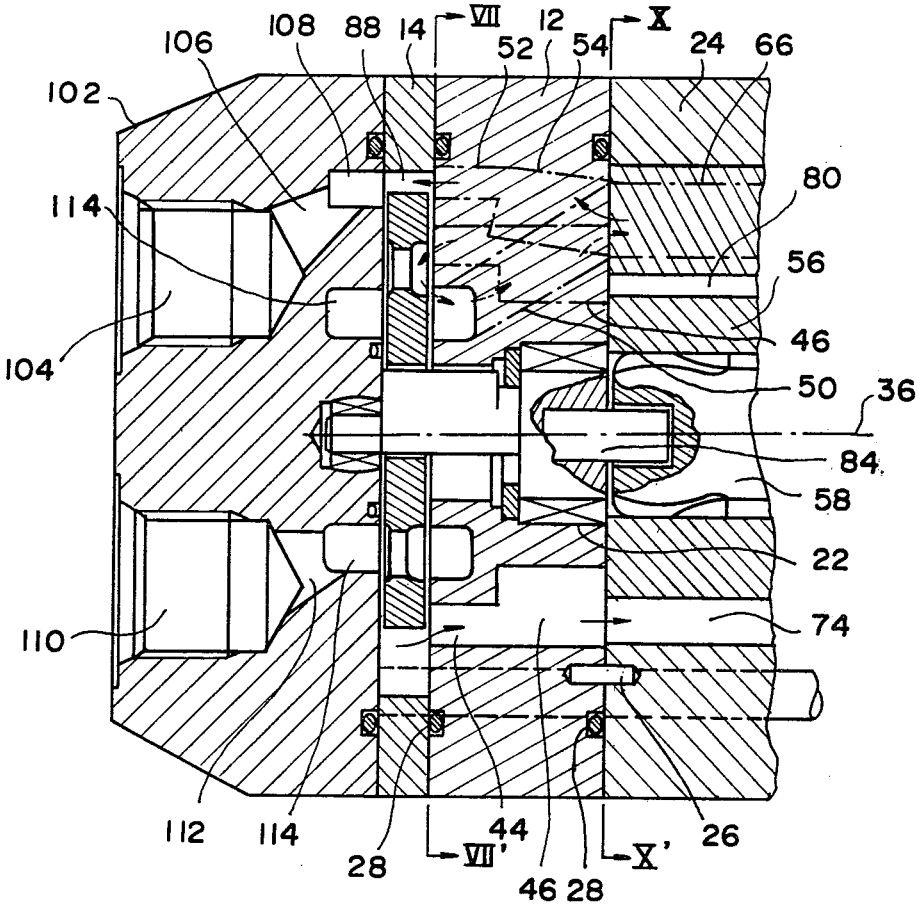
FIG. 12 is a longitudinal sectional view showing another embodiment of the rotary valve according to the invention.

FIG. 12 shows another embodiment of the rotary valve according to the invention which is the same as the embodiment of FIG. 1 with respect to the commutator 10, the port member 12 and the spacer 14 but differs by the use of an end cover 102. The end cover 102 is formed in one side with hydraulic pressure ports 104 and 110. The pressure port 104 is in communication through holes 106 and 108 with the cavity 88 provided between the commutator 10 and the spacer 14. The other pressure port 110 is in communication through a hole 112 with an annular groove 114 which is formed in the side of the end cover 102 which is in sliding contact with the commutator 10.

With the embodiment shown in FIG. 12, when the machine is used as a fluid motor and the drive shaft 58 is rotated clockwise, for example, the port 104 serves as an inlet for the hydraulic oil and the port 110 serves as an outlet for the hydraulic oil, thus providing similar oil passages to the commutator 10, the port member 12 and the Gerotor cavities as in the case of the embodiment shown in FIG. 1. Where the rotary valve of FIG. 12 including the ports 104 and 110 is employed, the oil inlet and outlet ports of the Gerotor motor or pump must be closed. Reversed rotation of the fluid motor in FIG. 12 without changing the positions of the fluid line connection to fluid ports 104 and 110, can be accomplished by only rotating 180° the end cover 102 so that the positions of the ports 104 and 110 in the figure will be replaced by each other.

It will thus be seen from the foregoing description that the rotary valve according to this invention has, by virtue of one or plurality of annular sealing means arranged on the sides of the rotary commutator, the effect of reducing or eliminating the problem of oil leakage for the rotary valve and improving the volumetric efficiency of Gerotor type motors or pumps over the prior art devices.

What is claimed is:

1. A rotary valve construction coupled to a drive shaft of a fluid motor or pump for selectively controlling fluid flow to a plurality of cavities defined by a stator having internal teeth and a rotor coupled to the drive shaft and having one less external tooth than the number of the teeth of said stator and in mesh with said stator eccentrically for orbital travel about an axis of rotation, said rotary valve construction comprising:

a pin coaxially coupled to the drive shaft;

an eccentric circular cam including a driving eccentric shaft and a driven eccentric shaft having a phase difference of 90° with said driving eccentric shaft, said driven shaft having an axis aligned with the axis of said stator, said driving shaft having an elongated hole receiving said pin in a position offset from the axis of said driven eccentric cam by an amount corresponding to the radius of the path of orbital travel of the rotor with respect to said stator so that the orbital rotation of the rotor is transmitted to said eccentric cam;

a commutator movably fitted on the driven eccentric shaft of said eccentric circular cam for orbital rotation therewith, said commutator having opposite sides and a pair of annular grooves formed in said sides and in communication with each other;

a spacer rotatably accommodating said commutator and determining a clearance on each side of said commutator, said commutator being rotatable within said spacer and defining a peripheral cavity therewith;

a port member having a plurality of passages selectively connecting (a) said cavities defined by the teeth of said stator and said rotor and selectively expanded and contracted in response to orbital rotation of said commutator and (b) the annular grooves of said commutator or (c) said peripheral cavity, said port member further having a pair of fluid passages respectively providing permanent communication between said annular grooves of said commutator and said peripheral cavity with the ambient atmosphere through said spacer;

an end cover axially secured to said stator; said port member and said spacer being axially secured, in this axial order, between said stator and said end cover, said end cover rotatably supporting said eccentric circular cam; and seal means between said end cover and said commutator at locations between the annular groove on the commutator and said peripheral cavity and between the annular groove on the commutator and the eccentric cam.

2. A rotary valve as claimed in claim 1 wherein said seal means comprises annular seal grooves provided in said end cover at said locations, a cap sealing member mounted in each said annular groove and contacting said commutator and a resilient ring member disposed inside said cap sealing member for applying resilient force thereto urging the cap member into contact with the commutator.

3. A rotary valve as claimed in claim 1 wherein said elongated hole is axially elongated and has an elliptical cross-section.

4. A rotary valve as claimed in claim 1 wherein said 90° phase difference between said driven and driving eccentric shafts is represented by the horizontal offset of the axis of said pin and the vertical offset of the center of said cam with respect to the axis of the center of the stator.

5. A rotary valve as claimed in claim 1 comprising further sealing means between said commutator and said port member at a location opposite the commutator between the annular groove on the commutator and the eccentric cam.

6. A rotary valve as claimed in claim 5 wherein said seal means comprises annular seal grooves provided in said cover end at said locations, said further seal means comprising an annular groove in said port member at a location opposite the commutator between said annular groove in the commutator and said eccentric cam, each of the sealing means and further sealing means further comprising a cap sealing member mounted in each said annular groove and contacting said commutator and a resilient ring member disposed inside said cap sealing member for applying resilient force thereto urging the cap member into contact with the commutator.

7. A rotary valve as claimed in claim 5 wherein said further seal means comprises an annular groove in said port member at a location opposite the commutator between said annular groove in the commutator and said eccentric cam, a cap sealing member mounted in said annular groove and contacting said commutator and a resilient ring member disposed inside said cap sealing member for applying resilient force thereto urging the cap member into contact with the commutator.

* * * * *